US008350710B2

(12) United States Patent
Logan et al.

(10) Patent No.: US 8,350,710 B2
(45) Date of Patent: Jan. 8, 2013

(54) SPACE MONITORING SYSTEM WITH REMOTE REPORTING

(75) Inventors: James A. C. Logan, North Wilkesboro, NC (US); Alvin C. West, Roaring River, NC (US)

(73) Assignee: James W. Foster, Boomer, NC (US)

( * ) Notice: Subject to any disclaimer, the term of this patent is extended or adjusted under 35 U.S.C. 154(b) by 676 days.

(21) Appl. No.: 12/556,141

(22) Filed: Sep. 9, 2009

(65) Prior Publication Data

US 2011/0057801 A1 Mar. 10, 2011

(51) Int. Cl.
*G08B 17/00* (2006.01)

(52) U.S. Cl. ..... 340/584; 340/581; 340/589; 340/573.6; 340/602; 340/604; 340/605; 52/169.5

(58) Field of Classification Search ..... 340/584, 340/581, 540, 573.6, 577, 602, 604, 605, 340/589; 700/299, 301; 405/270, 299; 52/169.5, 52/169.14

See application file for complete search history.

(56) References Cited

U.S. PATENT DOCUMENTS

| | | | | |
|---|---|---|---|---|
| 4,949,626 | A * | 8/1990 | Townsend et al. | 454/341 |
| 5,890,845 | A | 4/1999 | Buonaiuto, Sr. et al. | 405/268 |
| 6,276,093 | B1 * | 8/2001 | Janesky | 52/19 |
| 6,575,666 | B1 | 6/2003 | Janesky | 405/270 |
| 2005/0225442 | A1 * | 10/2005 | Kanayama | 340/539.13 |
| 2007/0175112 | A1 | 8/2007 | Janesky | 52/169.5 |
| 2008/0144697 | A1 * | 6/2008 | Stewart et al. | 374/141 |

* cited by examiner

*Primary Examiner* — Hung T. Nguyen
(74) *Attorney, Agent, or Firm* — Muncy, Geissler, Olds & Lowe, PLLC

(57) ABSTRACT

An enclosed space monitoring system includes a controller and a plurality of sensors. The sensors may include a humidity sensor, a water presence sensor, a water pump operation sensor, a temperature sensor, a radon gas detector, a propane or natural gas detector, a smoke sensor, a carbon monoxide detector and a motion sensor. Environmental parameter data obtained by the sensors is stored within a memory connected to the controller. The controller sends the data to a remote facility periodically and/or when the data indicates a potential condition within the space needing attention or remediation. The sent data is stored at the remote facility and may be accessed by a technician or an owner of the space. Also, the data may be comparatively studied relative to earlier data from the same space and to data collected in similar spaces to discern a potential condition needing attention or remediation.

20 Claims, 5 Drawing Sheets

SPACE MONITORING SYSTEM WITH REMOTE REPORTING

BACKGROUND OF THE INVENTION

1. Field of the Invention

The present invention relates to a system for monitoring a space and reporting parameter data to a remote facility. More particularly, the present invention relates to a monitoring system for a generally unoccupied enclosed space (such as a crawlspace, attic, storage room, utility closet, etc.) for measuring environmental parameters (such as humidity, temperature, gas presence) within the space and reporting those parameters to a remote server, where data is collected, monitored and reported to users in accordance with certain events.

2. Description of the Related Art

Manmade structures often include generally unoccupied enclosed spaces due to construction methods, such as a crawlspace under the living space of a house or an attic above the living space of the house. A crawlspace and an attic are both examples of enclosed spaces which are typically unoccupied by humans, and may not be inspected for extended periods of time, such as months or in some cases years. Other examples of enclosed spaces are specialized rooms, such as elevator control/equipment rooms, power utility closets, network closets, long-term storage units/garages and stored boat cabins. Such specialized rooms may not be visited for extended lengths of time, such as weeks or months.

When a space is unoccupied for an extended period of time, there is a risk that an environmental problem can develop in the space. Common problems are mold growth, water leakage from interior piping, gas leakage from interior piping, infiltration of environmental elements, e.g., wind and/or water from outside of the structure; infestation by rodents and/or insects. If unabated such problems can lead to mechanical damage and compromise the integrity of the structure, and can also damage articles stored in the unoccupied space.

For example, a water leak in a crawlspace can damage flooring and supports for flooring. Also, mold and gas leakage can be hazardous to the health of the occupants of the structure. Leaks in HVAC ductwork in the crawlspace or attic can cause poor heating/cooling performance in the occupied portions of the structure and will waste money in the operation costs of the HVAC system.

There are some systems known in the prior art to reduce the risks of the common problems in generally unoccupied spaces. For example, to reduce the risks of mold in the crawlspace, it is known to cover the ground surface with a water-resistant covering, such as a plastic layer or concrete to prevent moisture from the ground from entering the crawlspace. U.S. Pat. Nos. 5,890,845 and 6,575,666, as well as published U.S. Application 2007/0175112, each of which is incorporated herein by reference, detail covering systems for crawlspace floors. Published U.S. Application 2007/0175112 also shows an alarm system, whereby water at a drain is sensed. When the presence of water is detected at the drain, an alarm is sent to the homeowner to investigate.

SUMMARY OF THE INVENTION

The Applicants have appreciated one or more drawbacks with the space monitoring systems of the background art, and have appreciated a need for a comprehensive and modular system to remotely monitor conditions in a generally unoccupied space.

It is an object of the present invention to address one or more of the drawbacks of the prior art systems and/or Applicants' appreciated needs in the art.

These and other objects are accomplished by an enclosed space monitoring system including a controller and a plurality of sensors located within the enclosed space. The sensors may include a humidity sensor, a water presence sensor, a water pump operation sensor, a temperature sensor, a radon gas detector, a propane or natural gas detector, a smoke sensor, a carbon monoxide detector and a motion sensor. Environmental parameter data obtained by the sensors is stored within a memory connected to the controller. The controller sends the stored data to a remote facility when the data indicates a potential condition within the space needing attention or remediation. Further, the controller sends the data to the remote facility periodically. The sent data is stored at the remote facility and may be accessed by a technician or an owner of the space. Also, the data at the remote facility may be comparatively studied relative to earlier data from the same space and to data collected in similar spaces to discern a potential condition within the space needing attention or remediation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF THE INVENTION

Figure 1:
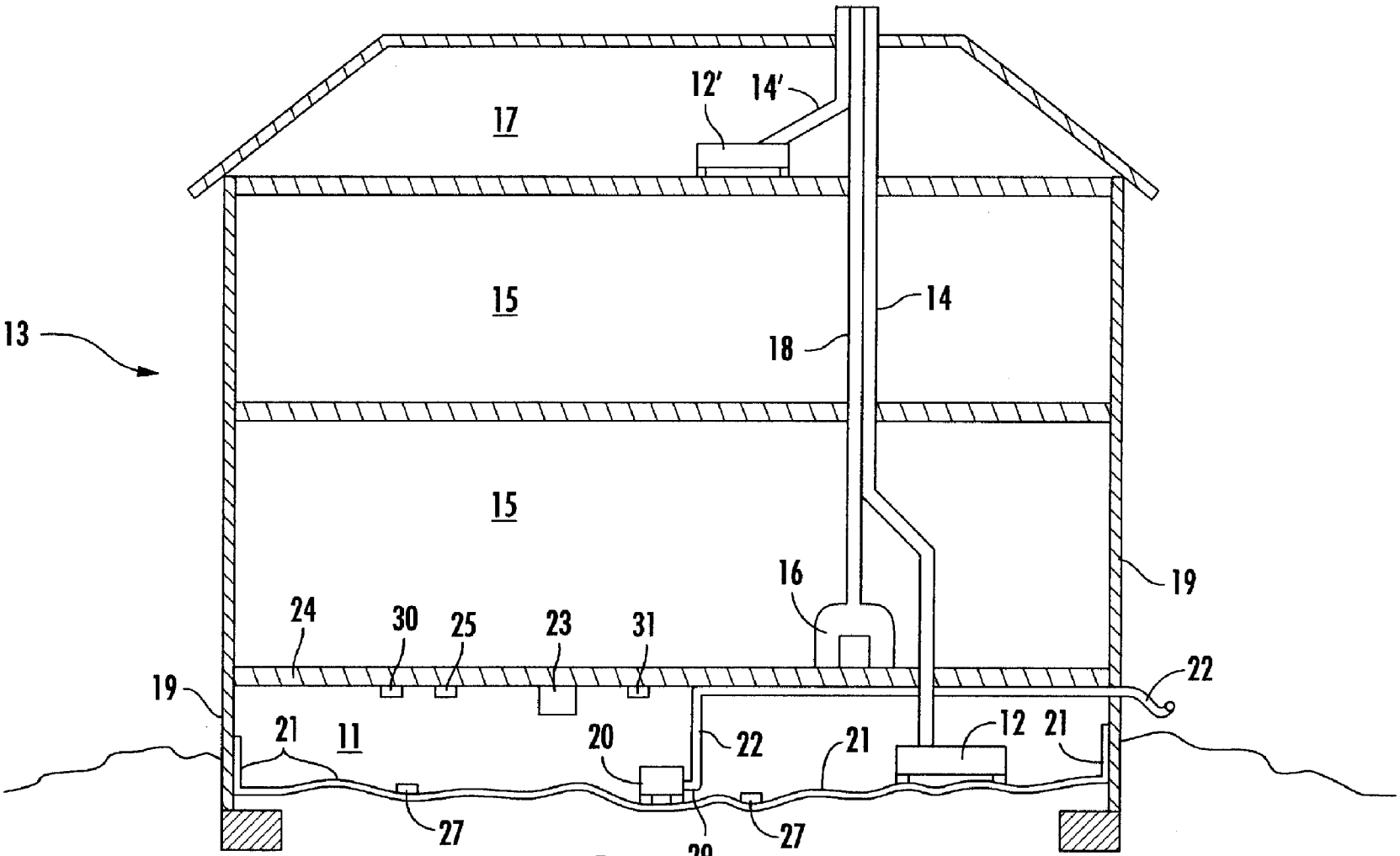
FIG. 1 is a side, cross sectional view of a crawlspace and a monitoring system, in accordance with an embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

FIG. 1 is a side, cross sectional view of a crawlspace and a monitoring system, in accordance with an embodiment of the present invention. In FIG. 1, a crawlspace system includes a crawlspace 11 located in the lowest level of a house 13. The house 13 also includes a living area 15 generally occupied by persons, which is located above the crawlspace 11, and an attic 17 located above the living area 15.

HVAC equipment 12, such as a gas furnace, may be located within the crawlspace 11. The gas furnace may include a flue 14 passing through the living area 15 and attic 17 to exit through a roof. The living area 15 may include a fireplace 16 with a separate flue 18 passing through the attic 17 to exit the roof. The attic 17 may include a second gas furnace 12' with a flue 14' exiting the roof.

In typical constructions, the crawlspace 11 has a dirt floor. The dirt floor allows moisture, and sometimes gases like radon, to radiant from the ground into the crawlspace 11. In typical constructions, the crawlspace 11 is vented to the outside air though the sidewalls 19 of the house 13. Passive venting is sometimes sufficient to keep moisture levels low enough to prevent the accumulation of mold in the crawlspace 11. Often, a power venting fan is used to move ambient air from outside of the house 13 through the crawlspace 11 to assist in reducing the humidity in the crawlspace 11 and to reduce the likelihood of mold formation and growth.

Unfortunately, passive venting and active venting (using fans) is not always sufficient to prevent mold formation and growth, especially in areas with high humidity weather (such as southern areas and waterfront areas), areas with excessive rainfall, areas in low elevations with poor draining soil, etc. Also, passive and active venting increases the likelihood of insect and rodent infestations inside of the crawlspace 11 due to the added potential entrances into the crawlspace 11. Further, a vented crawlspace 11 can reduce the efficiency of HVAC equipment 12 in the crawlspace 11, and also necessitate insulation on the underside of a floor 24 separating the crawlspace 11 from the living area 15.

The crawlspace 11 in FIG. 1 is an improvement over the typical vented crawlspace in that it has a barrier 21 of plastic or concrete, which allows substantially no moisture to pass therethrough. The barrier 21 completely covers the dirt floor residing between the sidewalls 19 of the crawlspace 11. The barrier 21 is sealed to the sidewalls 19. Any pre-existing venting in the sidewalls 19 communicating to the crawlspace 11 is closed off. The barrier 21 prevents moisture radiating from the ground from entering the crawlspace 11. Hence, the crawlspace 11 is substantially sealed to prevent the infiltration of exterior moisture into the crawlspace 11. Any moisture in the crawlspace 11 entering via air leaks to the outside environment or the living area 15, or introduced by the operation of the HVAC equipment 12, may be removed by a dehumidifier 20, which collects condensed water and pumps the collected water to the outdoors via a hose 22. This substantially sealed and conditioned atmosphere within the crawlspace 11 can greatly enhance the ability of the crawlspace 11 to remain mold free and odor free.

The present invention includes equipment located within the crawlspace 11 to monitor several parameters of the sealed crawlspace environment. Once the venting to the crawlspace is closed off to seal the crawlspace 11, it is important to monitor the environment within the crawlspace to prevent a small problem from becoming a hazardous or damaging situation. For example, a water leak in the water supply or water drain systems of the house will accumulate as standing water on top of the barrier 21, which can lead to structural damage, damage to the HVAC equipment 12 and/or dehumidifier 20 and mold causing conditions. Because the venting to the crawlspace 11 has been closed off, any gases (such as radon, propane or natural gas) entering the crawlspace 11 can also accumulate in the crawlspace 11.

In accordance with the present invention, a control unit 23 is mounted to a portion of the house 13. In the embodiment of FIG. 1, the control unit 23 is mounted in the crawlspace 11. However, the control unit 23 could also be mounted within the living area 15 of the house 13, if desired.

A plurality of sensors are located within the crawlspace 11 and connected to the control unit 23. The plurality of sensors include at least two sensors selected from a humidity sensor 25, a water presence sensor 27, a water pump operation sensor 29, a temperature sensor 31, a radon gas detector, a propane or natural gas detector, a smoke sensor, a carbon monoxide detector and a motion sensor (each being generically indicated as sensor 30). It is envisioned that the at least two sensors could be two or more water presence sensors 27, which are spread out to various low lying areas of the floor of the crawlspace 11. In a preferred basic embodiment of the present invention, the at least two sensors would include several water presence sensors 27 and a water pump operation sensor 29, which monitors the operation of a water pump within the dehumidifier 20 and/or the operation of a sump pump in a collection basin in the floor of the crawlspace 11.

The interconnection between the control unit 23 and the plurality of sensors 25, 27, 29, 30 and 31 will be discussed in greater detail with reference to FIG. 2.

Figure 2:
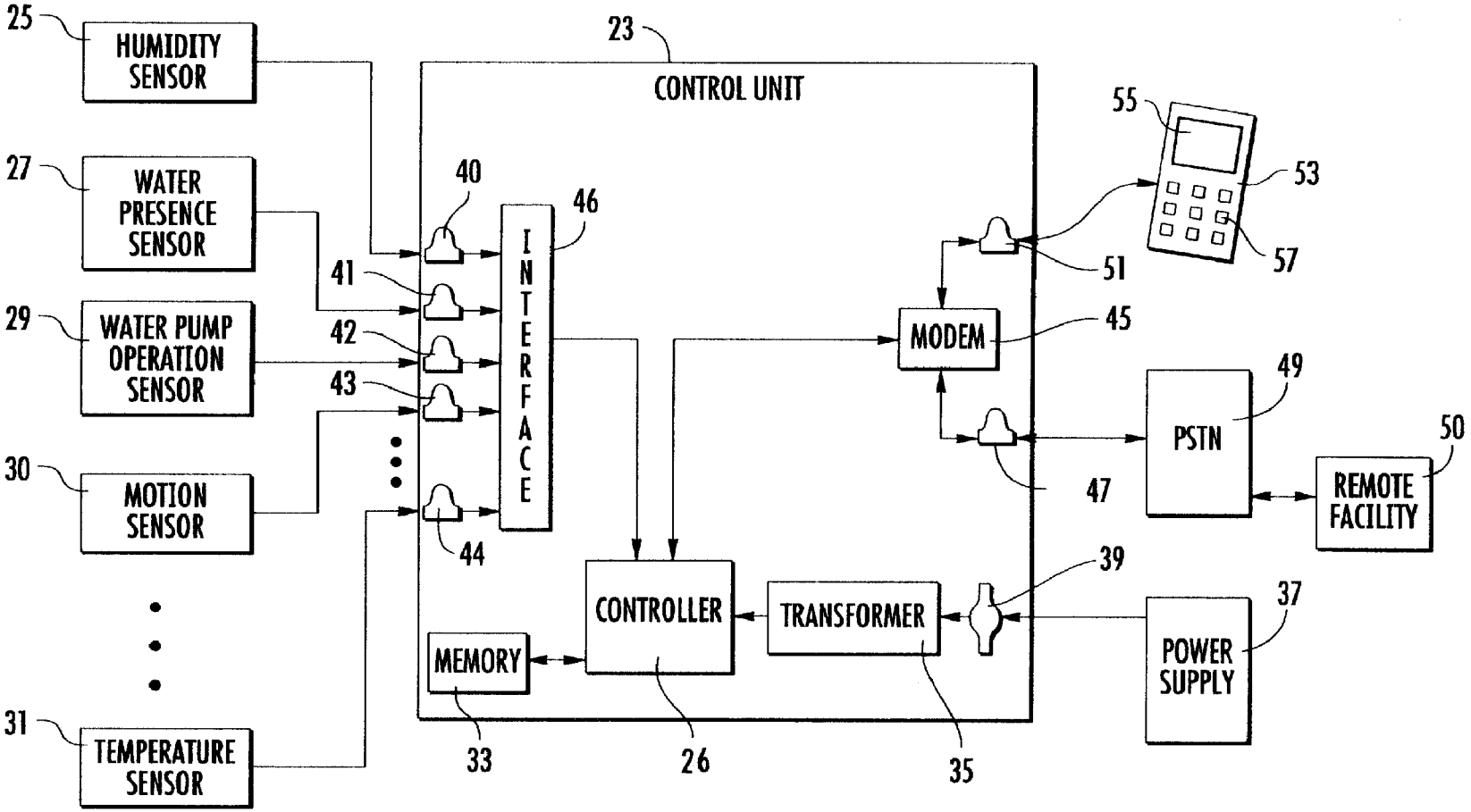
FIG. 2 is a block diagram illustrating the component parts of the monitoring system of FIG. 1.

FIG. 2 is a block diagram illustrating the component parts of the monitoring system of FIG. 1. The control unit 23 includes a controller 26, such as a microprocessor or specific function circuitry. The controller 26 is connected to a memory 33. The controller 26 is power from a transformer 35. The transformer 35 converts AC power received from a power supply 37 via a connector 39 into DC power useable by the controller 26. Of course, the transformer 35 could be outside of control unit 23 and plugged directly into a power supply, e.g., a wall outlet.

The sensors 25, 27, 29, 30 and 31 are connected into input ports 40, 41, 42, 43 and 44, respectively, by cables, such as twisted pair telephone/networking cables of the four or eight wire types. Of course, more ports could be included in control unit 23 if more sensors are employed. For example, control unit 23 could include sixteen sensor ports. In a preferred embodiment, the input ports 40, 41, 42, 43 and 44 are RJ-style ports (such as RJ-11 or RJ-45 ports), which accept a common telephone/networking modular plug.

The input ports 40, 41, 42, 43 and 44 are connected to an interface 46. The interface 46 facilitates transmission of the sensor signals to the controller 26. If the interface 46 is a multiplexer interface, the sensor signals may be sequentially sent to the controller 26 in serial fashion, or alternatively sent to the controller 26 in a non-sequential serial fashion in accordance with commands by the controller 26. The interface 46 may also represent a data bus interface, whereby the sensor signals are sent in parallel to the controller 26.

The controller 26 is also connected to a modem 45. The modem 45 is connected to a first jack 47 of the RJ-type. The first jack 47 receives a plug (e.g., RJ11 or RJ-45) of a telephone networking cable which is connected to a public switched telephone network (PSTN) 49. The PSTN 49 is connected to a remote facility 50, used to store, analyze and report data, as further discussed herein. The modem 45 facilitates two way communications between the controller 26 and the remote facility 50. The controller 26 may call the remote facility 50, e.g., by dialing a phone number, to download stored data and to receive programming updates, as will be discussed in greater detail herein. Optionally, the remote facility 50 can also call the controller 26 to reprogram the controller 26 (e.g., change predetermined values against which the sensor readings are compared, change the frequency of sensor readings, and/or to change the frequency of call-ins from the controller 26 to the remote facility 50).

Optionally, the modem 45 may also be connected to a second jack 51, e.g., an input/output port of the RJ-type. The second jack 51 receives a plug of a telephone networking cable which is connected to a hand held device 53, such as a handheld field interrogator unit. The hand held device 53 may include a display 55 and a plurality of input keys 57, where the input keys 57 may also be a part of the display 55 in the case of a touch screen. The modem 45 facilitates two way communications between the controller 26 and the hand held device 53. The controller 26 may download stored data to the hand held device 53, in a same manner as data is downloaded to the remote facility 50. Also, the hand held device 53 can be used to reprogram the controller 26, as discussed previously.

Figure 3:
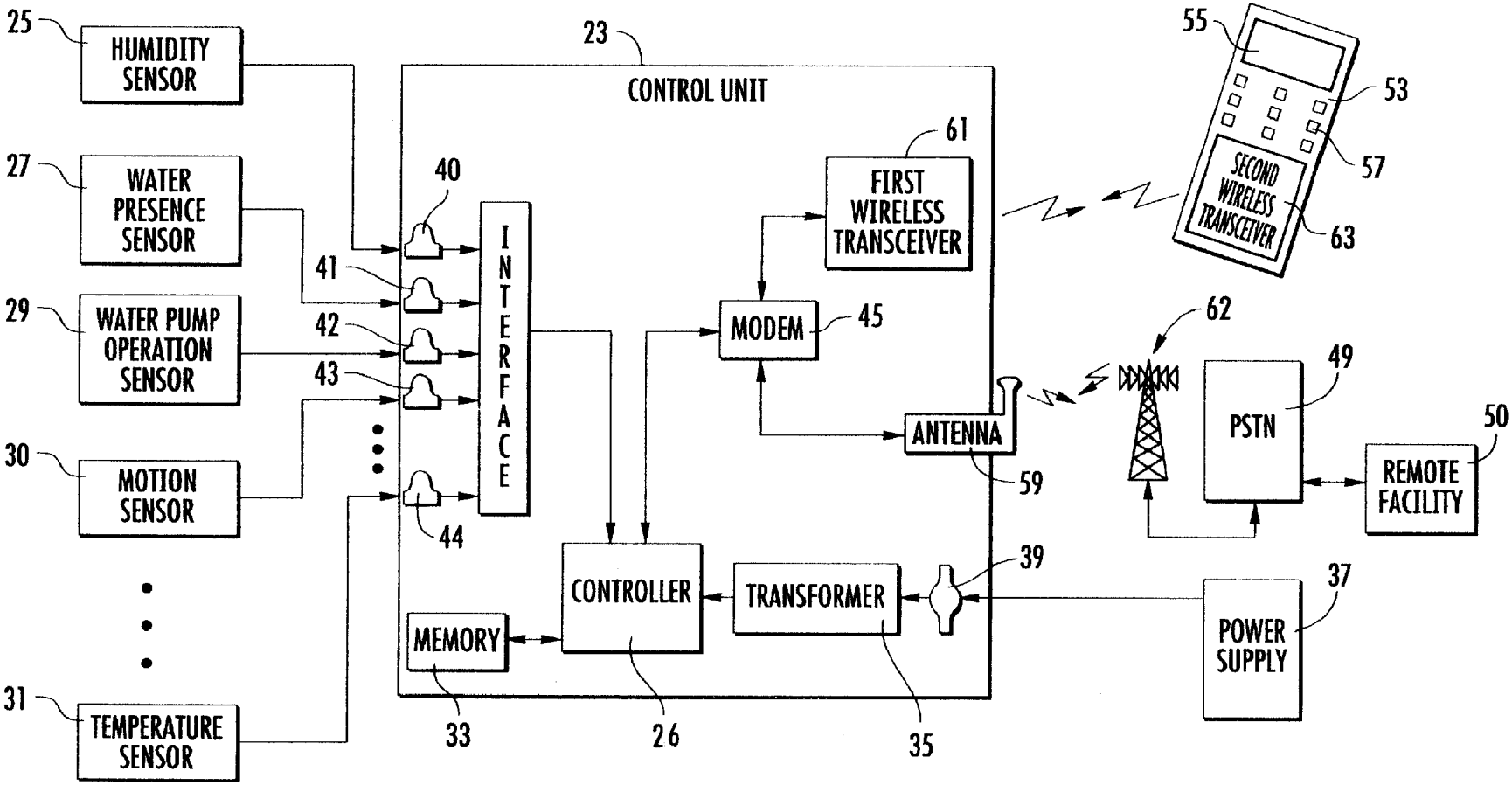
FIG. 3 is a block diagram illustrating the component parts of the monitoring system of FIG. 1, in accordance with an alternative embodiment.

FIG. 3 shows an alternative embodiment to the block diagram of FIG. 2. In FIG. 3, the control unit 23 does not include the first and second jacks 47 and 51. The first jack 47 has been replaced by an antenna 59. The antenna 59 is adapted to communicate with a cellular telephone network 62, so that the controller 26 communicates with the PSTN 49 and hence the remote facility 50 via the cellular telephone network 62. The second jack 51 has been replaced by a first wireless transceiver 61, such as a bluetooth transceiver or an infrared transceiver, so that the controller 26 can communicate with a second wireless transceiver 63 in the handheld device 53 over a wireless link.

FIG. 3 depicts that the connection between the handheld device 53 and the control unit 23 and the connection between the PSTN 49 and control unit 23 may be wireless. It would also be within the scope of the present invention to provide for wireless connections between the plurality of sensors 25, 27, 29, 30 and 31 and the control unit 23. The plurality of sensors 25, 27, 29, 30 and 31 could be battery powered and transmit readings periodically (e.g., every 30 seconds or 1 minute) to the control unit via a pairing of RF transmitters and receivers (e.g., of the 900 MHz or 2.4 GHz type). The modem 45, as described in conjunction with FIGS. 2 and 3, should be construed broadly to encompass any device which facilitates two-way communication between the controller 26 and an outside device.

Figure 4:
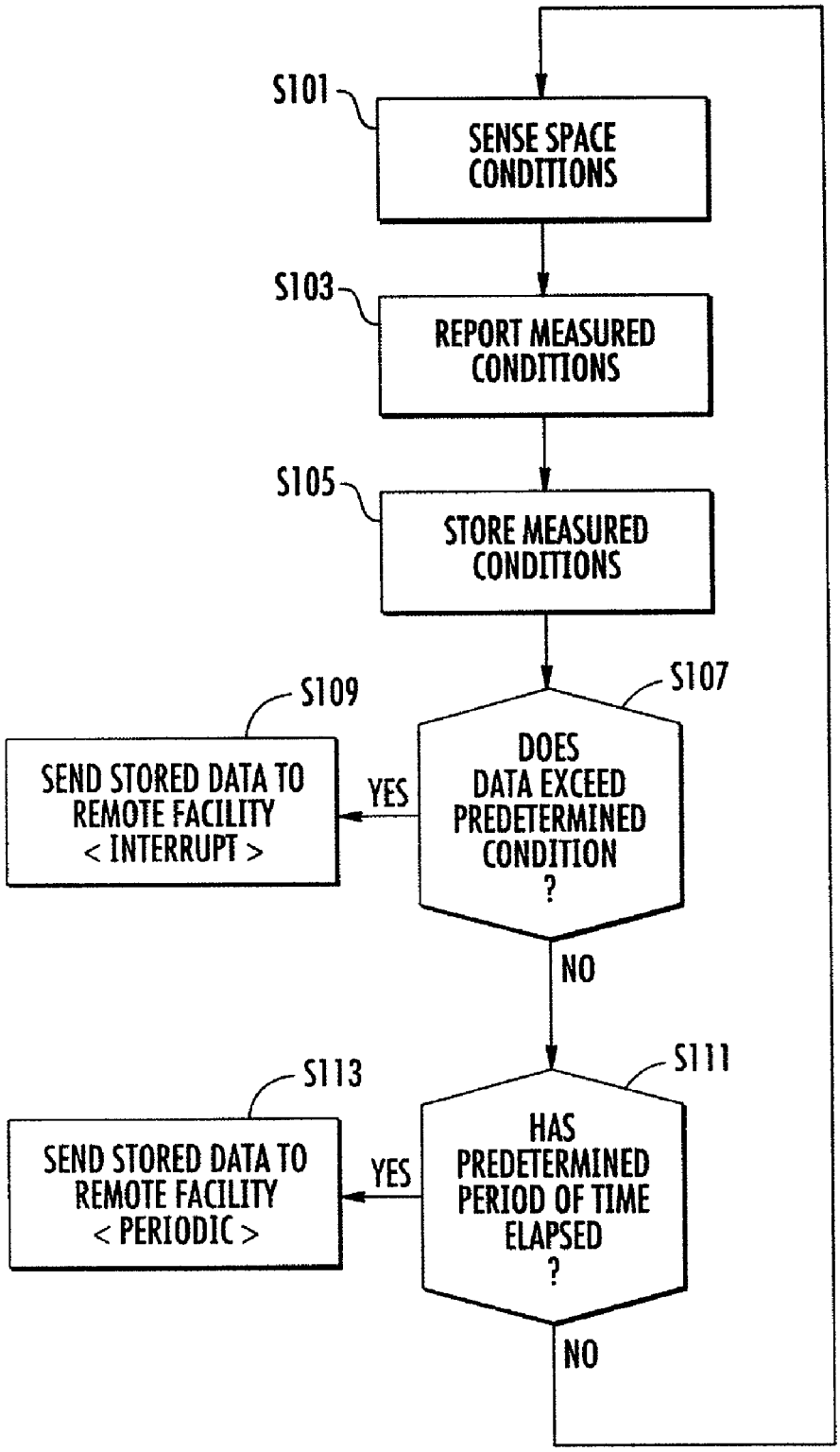
FIG. 4 is a flow chart illustrating a method of operation of the component parts located at the monitored space.

Now, with reference to the flow chart in FIG. 4, a method for monitoring a substantially enclosed space will be explained in greater detail. In step S101, the plurality of sensors 25, 27, 29, 30 and 31 sense data relating to environmental conditions within the substantially enclosed space. In a preferred embodiment, the sensors 25, 27, 29, 30 and 31 are passive devices and the power is periodically supplied to a respective sensor by the control unit 23 over the link (e.g., phone line) existing between the respective sensor and a respective port 40, 41, 42, 43 and 44. In response to the power signal, the sensor reports a data reading (Step S103) to the control unit 23 (e.g. a variable resistive reading is measured from the sensor indicative of temperature, humidity, water presence, etc.) In an alternative embodiment, the sensors 25, 27, 29, 30 and 31 are active devices (e.g., battery powered) and report data (Step S103) to the control unit 23 periodically.

In step S105, the reported data is stored in the memory 33 connected to the controller 26. The reported data may optional be stored in the memory 33 in combination with time stamp data (e.g., date and time), so that the recorded data is linked to a respective time stamp. In step S107, the stored data is compared to a predetermined condition. If the predetermined condition is exceeded, some or all of the stored data is sent, using the modem 45, to the remote facility 50 (Step S109). Also, failure to receive any signal from a polled sensor is considered to be a condition exceeding the predetermined condition. If the predetermined condition is exceeded, a potential abnormality may exist within the substantially enclosed area 11.

The potential abnormality may be the presence of water on the barrier 21 as detected by the water presence sensors 27 lying in the low spots of the enclosed area 11 (indicative of flooding or leaking water lines); high or low temperature as detected by the temperature sensor 31 (indicative of an open door to the enclosed area 11, failure of the HVAC equipment 12, etc.); high or low humidity as detected by the humidity sensor 25 (indicative of failure of the dehumidifier 20, an open door to the enclosed area 11, failure of the HVAC equipment 12, etc.); a high radon reading (indicative of a failure of mitigation venting below the barrier 21 or a change in the natural, preexisting radon level); a high propane or natural gas reading (indicative of a leak in piping); a water pump operation failure signal as detected by sensor 29 (indicate of a failure with a sump pump or water pump of the dehumidifier 20); a reading of smoke above a predetermined level (indicative of a fire); a reading of a high carbon monoxide level (indicative of a failure or leak in the flue 14 or 14' or a fire within or adjacent to the enclosed area 11).

If the predetermined condition is not exceeded in step S107, the process proceeds to step S111. In step S111, a clock or timer is checked. If a predetermined period of time has elapsed, some or all of the stored data is sent, using the modem 45, to the remote facility 50 (Step S113). If the predetermined period of time has not elapsed, the process returns to step S101. The predetermined period of time may be set by the manufacturer at the time of software installation into the memory 33. In a preferred embodiment, the predetermined period of time can be changed at a later date using the remote facility 50 or the handheld device 53. A typical predetermined period of time would be once a month (e.g., once about every 30 days). Other time periods may be desirable, e.g., once a day, once a week.

The remote facility 50 records the date (e.g., date and time) when data is received from the control unit 23. If a control unit 23 fails to periodically report data in accordance with its programmed time interval for reporting, a service call is generated. The service call may be sent to the operator of the remote facility and/or the owner of the property. The service call may be indicative of a likelihood of a condition within the substantially enclosed space 11 which needs remediation, e.g., a power failure (tripped circuit) to the control unit 23 and/or failure or damage to the control unit 23 (e.g., a surge damaged modem 45, flooding in the enclosed area, etc.).

Figure 5:
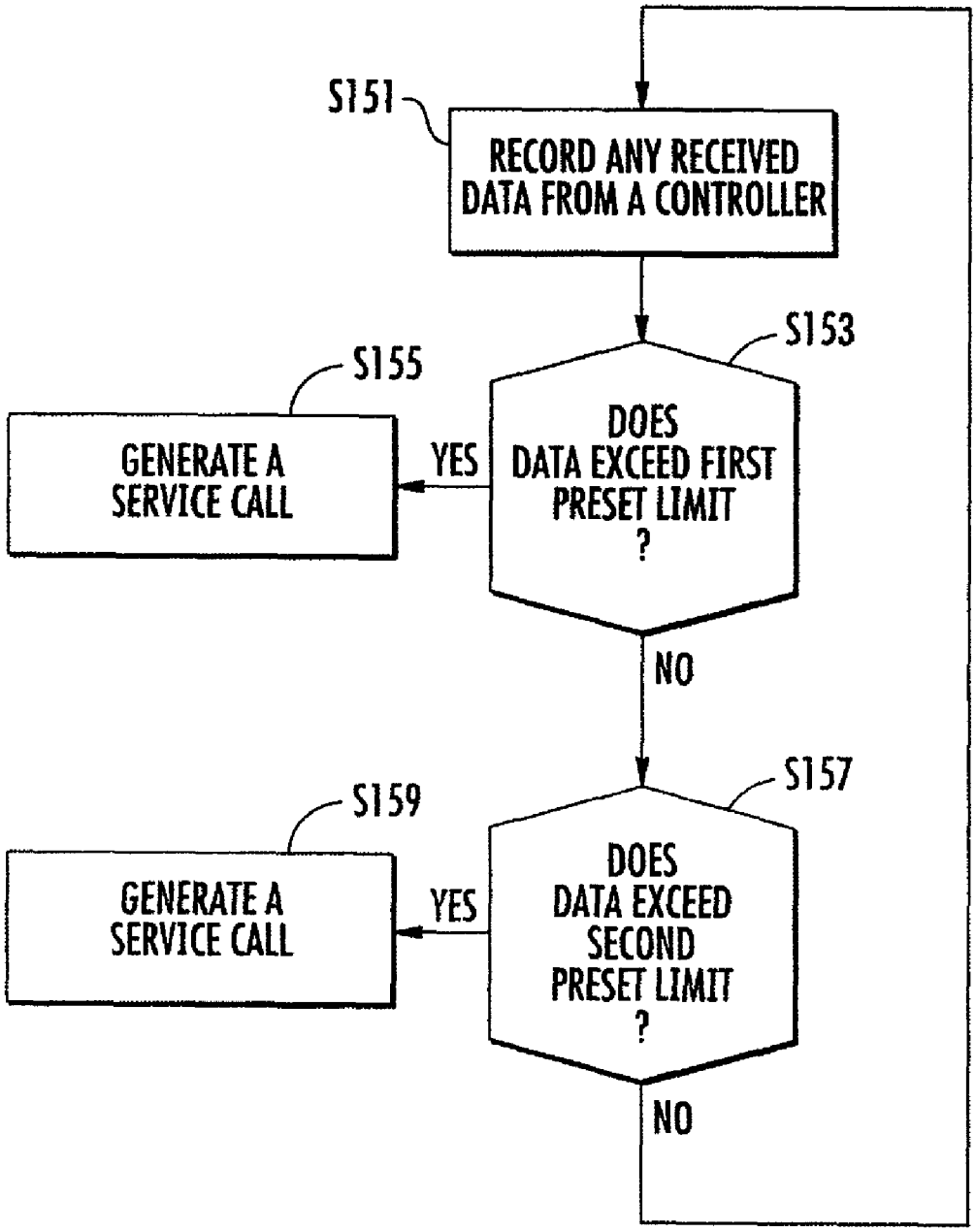
FIG. 5 is a flow chart illustrating a method of operation at the remote facility.

The data reported in step S109 will be received at the remote facility 50 as an interrupt and automatically cause the remote facility 50 to generate a service call to investigate the potentially abnormal situation causing the data to exceed the predetermined acceptable range. The service call may be sent to the property owner and/or the operator of the remote facility. The data reported in step S113 is a periodic report and typically does not cause a service call to be generated by the remote facility 50. However, the remote facility 50 may optionally perform further analysis on the data received in step S113 to determine if a service call is warranted. FIG. 5 is a flow chart illustrating one embodiment of the further analysis which may be performed by the remote facility 50.

In step S151 of FIG. 5, data received from a control unit 23 (step S113, FIG. 4) is recorded at the remote facility 50. Next, in step S153, the recorded data is analyzed by comparing the recorded data to previously recorded data from the same enclosed area 11. If the comparison shows a data deviation exceeding a first preset limit, a service call is generated in step S155. If the comparison does not show a data deviation exceeding the first preset limit, the process proceeds to step S157.

In step S155, the remote facility 50 has determined a likelihood of a condition within the substantially enclosed space 11 which needs remediation. For example, if the average temperature measured in the enclosed area 11 in December 2008 is statistically higher (e.g. 12 degrees higher) than the average temperature recorded in the same enclosed area 11 during December 2007, there could be a potential problem with the HVAC equipment 12 or ductwork leaking heat into the enclosed area 11. If the average temperature measured in the enclosed area 11 in December 2008 is statistically lower (e.g., 12 degrees lower) than the average temperature recorded in the same enclosed area 11 during December 2007, there could be a potential problem with fallen insulation from the sidewall 19, a partially open door to the enclosed space 11, etc. Past weather data, relevant to the time period under consideration, as obtained from an Internet source, could be used to set the statistically significant threshold value.

As another example, a sensor could measure the amount of time the dehumidifier 20 operates. If the time of operation in December 2008 is statistically higher (e.g. 20 hours longer) than the time of operation in December 2007, there could be a potential problem of debris or dirt blocking the fins of the dehumidifier 20. If the average radon level measured in the enclosed area 11 in December 2008 is statistically higher than the average radon level recorded in the same enclosed area 11 during December 2008, there could be a potential problem with the venting system beneath the barrier 21 and the vents may need to be inspected, tested, and/or blown out to be cleared.

In step S157, the recorded data is analyzed by comparing the recorded data to previously recorded data from a different enclosed area having similar characteristics. If the comparison shows a data deviation exceeding a second preset limit, a service call is generated in step S159. If the comparison does not show a data deviation exceeding the second preset limit, the process returns to step S151.

In step S159, the remote facility 50 has determined a likelihood of a condition within the substantially enclosed space 11 which needs remediation. For example, in step S157, the data from a monitored crawlspace of 2,000 square foot size could be compared to the monitored and recorded data relating to a crawlspace of 1,800 square foot size in the same neighborhood (e.g., across the street). If the average temperature increase in the enclosed area 11 comparing November 2008 to December 2008 is statistically higher (e.g. 4 degrees higher) than the average temperature increase recorded (November 2008 to December 2008) in the different enclosed area (e.g., the crawlspace of the house across the street), there could be a potential problem with the HVAC equipment 12 or ductwork leaking heat into the enclosed area 11. In other words, if the average temperature in crawlspace A, crawlspace B and crawlspace C (all in the same neighborhood) was 52 degrees in November 2008 and the average temperature in crawlspace A and crawlspace B was 46 degrees in December 2008, while the average temperature in crawlspace C was 51 degrees in December 2008, there is a potential of a failure of a system in crawlspace C. It is highly likely that the houses, being in the same neighborhood experienced similar weather patterns. Therefore, one would expect highly similar changes in the monitor parameters within the crawlspaces A, B and C.

A service call is typically sent to the operator of the remote facility 50. However, in optional embodiments, the service call may also result in the sending of an email message (or automated telephone call) to the property owner regarding any determination of a potential abnormality within the substantially enclosed area. Also, the data stored in the remote facility 50 relating to a particular enclosed area 11 may optionally be accessible to the enclosed area 11's respective property owner via the Internet. Such data may be useful to the property owner for the study of trends in the measured parameters to see if improvements (e.g., new HVAC equipment, added insulation) have changed the measured parameters over time.

Although the present invention has been described as a system for monitoring the conditions within a crawlspace 11, the system could be used to monitor the conditions within other generally enclosed spaces. For example, the attic 17 includes the second gas furnace 12' with the flue 14', which could release gases. Rainwater could leak through the roof and enter the attic 17, a water pipe in the attic space could burst or leak, and/or insects and rodents could infest the attic 17. Therefore, another similarly configured system could be used to monitor the attic 17. Examples of other enclosed spaces which could be monitored by the system of present invention include an elevator equipment room, a networking closet, a boiler room, an electrical utility room, a docked/stored boat's cabin or equipment room, or any other type of generally enclosed space which is not regularly occupied or inspected.

As used herein, the term substantially enclosed space shall mean a space which does not have a large opening to an adjacent space (such as the outdoors). A substantially enclosed space may have air leaks to adjacent spaces (e.g., around doors, windows, at the meetings of building materials), small openings to permit the passage of pipes, conduits, wiring, flues, etc. to adjacent spaces, and other small openings to adjacent spaces (not to exceed 10% of the total surface areas defining the enclosed space).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

We claim:

1. A substantially enclosed crawlspace system comprising:

a crawlspace located beneath a house;

a barrier of plastic or concrete, which allows substantially no moisture to pass therethrough, covering a floor residing between sidewalls of said crawlspace, said barrier being sealed to said sidewalls of said crawlspace;

a controller mounted to a portion of said house; and a plurality of sensors located within said substantially enclosed crawlspace and connected to said controller, wherein said plurality of sensors include at least two sensors selected from a humidity sensor, a water presence sensor, a water pump operation sensor and a temperature sensor;

a memory connected to said controller for storing data collected by said plurality of sensors; and a modem connected to said controller, wherein said controller employs said modem to send some or all of the stored data within said memory to a remote facility when the data meets a predetermined condition, and wherein said controller employs said modem to periodically send some or all of the stored data within said memory to the remote facility regardless of whether or not the stored data within said memory meets the predetermined condition.

2. The substantially enclosed crawlspace system of claim 1, wherein said at least two sensors include a water presence sensor and a water pump operation sensor.

3. The substantially enclosed crawlspace system of claim 1, wherein said controller is connected to a plurality of input ports, each dimensioned to receive an RJ-11 or RJ-45 plug associated with a sensor of said plurality of sensors.

4. The substantially enclosed crawlspace system of claim 1, further comprising:

a handheld field interrogator unit, wherein said handheld field interrogator unit is adapted to communicate with said controller and to retrieve the stored data within said memory.

5. The substantially enclosed crawlspace system of claim 4, wherein said controller includes an input/output port, and wherein said handheld field interrogator retrieves data from said memory through a physical communication link to said input/output port of said controller.

6. The substantially enclosed crawlspace system of claim 4, wherein said controller includes a first wireless transceiver, wherein said handheld field interrogator includes a second wireless transceiver, and wherein said handheld field interrogator receives data from said memory through a wireless data link between said first and second wireless transceivers.

7. The substantially enclosed crawlspace system of claim 1, wherein said modem is connected to a landline telephone system and communicates with the remote facility via the public switched telephone network (PSTN).

8. The substantially enclosed crawlspace system of claim 1, wherein said modem is attached to an antenna and communicates with the remote facility via a cellular telephone network.

9. A substantially enclosed space monitoring system comprising:

a controller;

a plurality of sensors located within the substantially enclosed space and connected to said controller, wherein said plurality of sensors include at least two sensors selected from a humidity sensor, a water presence sensor, a water pump operation sensor, a temperature sensor, a radon gas detector, a propane or natural gas detector, a smoke sensor, a carbon monoxide detector and a motion sensor;

a memory connected to said controller for storing data collected by said plurality of sensors; and a modem connected to said controller, wherein said controller employs said modem to send some or all of the stored data within said memory to a remote facility when the data meets a predetermined condition, and wherein said controller employs said modem to periodically send some or all of the stored data within said memory to the remote facility regardless of whether or not the stored data within said memory meets the predetermined condition.

10. The substantially enclosed space monitoring system of claim 9, wherein said controller is connected to an input/output port for accepting a physical communication link for communicating with a handheld field interrogator.

11. The substantially enclosed space monitoring system of claim 9, wherein said controller is connected to a first wireless transceiver for wirelessly communicating with a second wireless transceiver of a handheld field interrogator.

12. The substantially enclosed space monitoring system of claim 9, wherein said enclosed space is a boat cabin.

13. The substantially enclosed space monitoring system of claim 9, wherein said enclosed space is an attic.

14. A method of operating a system for monitoring a substantially enclosed space comprising:

providing a controller;

providing a plurality of sensors located within the substantially enclosed space and connected to the controller, wherein the plurality of sensors include at least two sensors selected from a humidity sensor, a water presence sensor, a water pump operation sensor, a temperature sensor, a radon gas detector, a propane or natural gas detector, a smoke sensor, a carbon monoxide detector and a motion sensor;

providing a memory connected to the controller;

providing a modem connected to the controller;

sensing data relating to environmental conditions within the substantially enclosed space using the plurality of sensors;

reporting the sensed data to the controller;

storing the reported data in the memory connected to the controller;

sending the stored data using the modem to a remote facility when the stored data meets a predetermined condition, and sending the stored data using the modem to the remote facility periodically regardless of whether or not the stored data meets the predetermined condition.

15. The method of claim 14, wherein the stored data is periodically sent about every 30 days to the remote facility.

16. The method of claim 14, wherein the sent data is recorded at the remote facility, and further comprising:

analyzing the recorded data to determine a potential abnormality within the substantially enclosed area by:

comparing the recorded data to previously recorded data from the same enclosed area; and determining if the comparison shows a data deviation from the previously recorded data in a manner to indicate a likelihood of a condition within the substantially enclosed space which needs remediation.

17. The method of claim 14, wherein the sent data is recorded at the remote facility, and further comprising:

analyzing the recorded data to determine a potential abnormality within the substantially enclosed area by:

comparing the recorded data to previously recorded data from a different enclosed area; and determining if the comparison shows a data deviation from the previously recorded data in a manner to indicate a likelihood of a condition within the substantially enclosed space which needs remediation.

18. The method of claim 14, wherein the sent data is recorded at the remote facility, and further comprising:

analyzing the recorded data to determine a potential abnormality within the substantially enclosed area; and sending an email message to the property owner regarding any determination of a potential abnormality within the substantially enclosed area.

19. The method of claim 14, wherein the sent data is recorded at the remote facility, and further comprising:

providing access to the recorded data to the property owner of the substantially enclosed space via the Internet.

20. The method of claim 14, wherein failure to receive data from a controller after expiry of a predetermined time after the scheduled periodic transmission from the controller is determined by the remote facility to be indicative of a likelihood of a condition within the substantially enclosed space which needs remediation.

* * * * *